US006704971B2

(12) United States Patent
Dossett et al.

(10) Patent No.: US 6,704,971 B2
(45) Date of Patent: Mar. 16, 2004

(54) PRODUCT STOCKING METHOD AND DEVICE

(75) Inventors: Larry R. Dossett, Manchester, GA (US); Michael D. Harper, Manchester, GA (US); Charles T. Henry, Fayetteville, GA (US); Kim V. Peterson, Manchester, GA (US); Pedro A. Sosa, LaGrange, GA (US); Jeffrey J. Meve, Fayetteville, GA (US); Ryan W. Murphy, Peachtree City, GA (US); John P. Scarbrough, Fayetteville, GA (US)

(73) Assignee: Goody Products Inc., Peachtree City, GA (US)

( * ) Notice: Subject to any disclaimer, the term of this patent is extended or adjusted under 35 U.S.C. 154(b) by 0 days.

(21) Appl. No.: 10/159,445

(22) Filed: May 31, 2002

(65) Prior Publication Data

US 2003/0000052 A1 Jan. 2, 2003

Related U.S. Application Data

(63) Continuation-in-part of application No. 09/564,762, filed on May 4, 2000, now Pat. No. 6,401,304.
(60) Provisional application No. 60/326,366, filed on Oct. 1, 2001.

(51) Int. Cl.[7] ..... A44B 21/00; G90F 3/18; G90F 23/00

(52) U.S. Cl. ..... 24/16 PB; 53/399; 29/241

(58) Field of Search ..... 24/17 AD, 16 R, 24/16 PB, 30.5 P, 30.5 R; 29/241; 206/425, 452, 451, 806; 53/379, 581, 447; 40/668, 665

(56) References Cited

U.S. PATENT DOCUMENTS

| | | | | |
|---|---|---|---|---|
| 2,016,059 A | | 10/1935 | Stevens | 40/668 |
| 2,153,227 A | | 4/1939 | Allstatter | 40/668 |
| 2,554,105 A | | 5/1951 | Heinle | 24/16 |
| 3,816,881 A | * | 6/1974 | Van Riper, Jr. | 24/114.3 |
| 4,149,329 A | | 4/1979 | Graves | 40/21 R |
| 4,570,368 A | | 2/1986 | Stover | 40/10 C |
| 4,877,068 A | | 10/1989 | Blake | 141/390 |
| 5,584,103 A | | 12/1996 | Slavin | 24/16 R |
| 5,878,520 A | | 3/1999 | Milbrandt et al. | 40/665 |
| 6,058,639 A | | 5/2000 | Tinklenberg et al. | 40/665 |
| 6,226,911 B1 | | 5/2001 | Wescombe | 40/668 |

* cited by examiner

*Primary Examiner*—Robert J. Sandy
(74) *Attorney, Agent, or Firm*—Marshall, Gerstein & Borun LLP

(57) ABSTRACT

A product stocking device is disclosed that retains a plurality of display packages, so that the plurality of display packages are readily aligned for simplified mounting onto a display hanger. The stocking device has a first section and a second section, the second section threads through apertures in the plurality of display packages and is then coupled to a coupling portion.

31 Claims, 4 Drawing Sheets

PRODUCT STOCKING METHOD AND DEVICE

RELATED APPLICATION DATA

The present application is a continuation-in-part of U.S. patent application Ser. No. 09/564,762, which was filed on May 4, 2000, now U.S. Pat. No. 6,401,304, and claims priority to co-pending U.S. provisional application Serial No. 60/326,366, which was filed on Oct. 1, 2001.

FIELD OF THE DISCLOSURE

The invention generally relates to a product stocking device, and more particularly, to a product stocking device for placing a plurality of packaged products on a display device in a substantially single step.

BACKGROUND OF THE DISCLOSURE

It is well known to package products in a variety of display packages, such as display bags, blister packs, display cards, display containers, display tubes, or the like. The display packages usually include an aperture adjacent the top of each package, such that the display packages may hang from display hangers or peg hooks that extend from a display or display shelf.

Conventionally to display the display packages, a stocker retrieves each display bag, blister pack, display card, display container, or the like from a box or larger bag containing a multiplicity of display packages and mounts each display package individually onto a display hanger. Alternatively, a stocker takes a plurality of display packages from the box or larger bag and aligns the mounting apertures by hand and in turn mounts the plurality of display packages onto a display hanger. For the stocker, the process of mounting the display package onto the display hangers is a tedious and time consuming task that requires exceedingly repetitive work. Having such repetitive work for a stocker increases costs for the store employing the stocker and also increases the chances that the individual display packages could be dropped by the stocker, possibly causing damage to the product or the packaging itself, and that the display package could be torn or damaged because of the careless package handling brought on by the tedium of the stocking task.

It is known in the art to insert a common twist tie through the apertures of a plurality of display bags. The twist tie substantially causes coaxial alignment of the display bag apertures. The twist tie partially solves the problem of requiring a stocker to stock individual display bags one at a time. A twist tie however has the disadvantage of being difficult to manually disengage from the plurality of bags without the use of a suitable tool. Further, a twist tie requires a substantial twisting effort in putting together the plurality of bags. Further still, a twist tie does not have an area providing for easy labeling of the products that are held by the twist tie or for easy grasping by a stocker.

Thus, there is a need and desire for a device that improves the efficiency of handling a multiplicity of display packages to be mounted onto display hangers. There is also a need and desire for an efficient method of mounting a plurality of display packages onto display hangers. Further, there is a need and desire for a device which keeps a plurality of display packages together so that the plurality of display packages can be easily mounted onto display hangers in a substantially single step. Further still, there is a need and desire for a device that holds together a plurality of display packages that can be easily manufactured with little expense and can be easily packaged along with the plurality of display packages in a case or box, e.g. shipping container, containing a plurality of display packages.

SUMMARY OF THE DISCLOSURE

In accordance with one aspect of the disclosure a device for retaining a plurality of display packages is disclosed. Each display package has a display aperture. The product stocking device includes a first section having a stop member, a second section, and a coupling portion. The coupling portion is adapted to engage the second section, thereby retaining the plurality of display packages on the first section between the stop member and the second section.

In accordance with another aspect of the disclosure a system for packaging a multiplicity of display packages in a shipping container is disclosed. Each display package has a display aperture. The system includes at least one stocking device having a first section and a second section. The first section is threadable through the display apertures in a plurality of display packages. The stocking device has a coupling aperture to which the second section is coupled, thereby retaining the display packages.

In accordance with another aspect of the disclosure, a method of packaging a multiplicity of display packages is disclosed. Each display package has a display aperture. The method includes threading a stocking device, having a first section, a second section, and a coupling portion, through the display apertures of a plurality of display packages. The method also includes coupling the second section of the stocking device to the coupling portion. The method further includes placing the plurality of display packages being retained by the stocking device into a shipping container.

Figure 1:
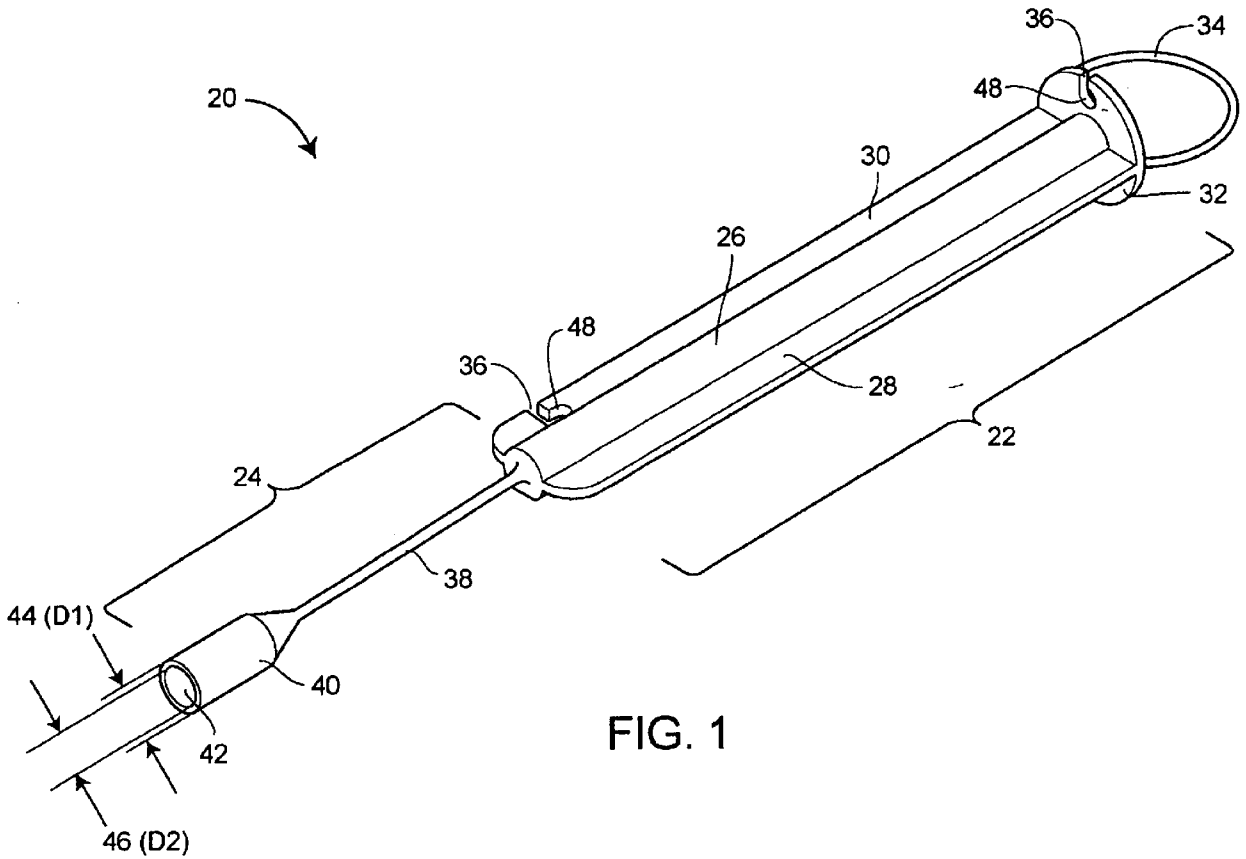
FIG. 1 is a perspective view of a product stocking device.

While the method and device described herein are susceptible to various modifications and alternative constructions, certain illustrative embodiments thereof has been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION

Figure 3:
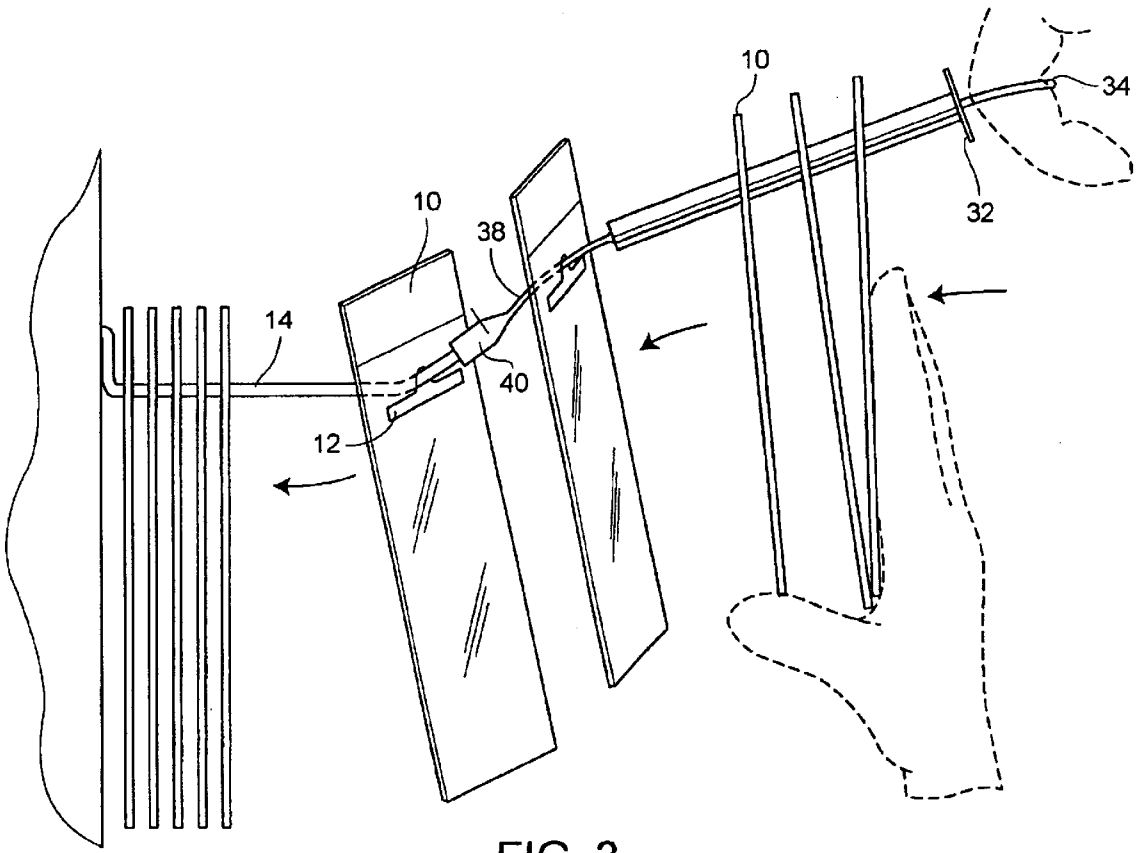
FIG. 3 is a perspective view of a plurality of display packages being transferred from the product stocking device of FIG. 1, to a product display device.

A display package 10 (shown as a card-type packaging) may contain a product, including, but not limited to, hardware items, school or office supplies, etc. Each display package 10 may include an aperture 12 adjacent its top for mounting onto a display device 14 (shown as an elongate peg hook, which extends from an upright display, wall, display case, or the like). Display packages 10 shown in the FIG. 3 are exemplary of the type of display packages that can be utilized with a stocking device; however, any of a variety of rigid or flexible display packages having at least one aperture for hanging on a hanger, rod, hook, or post, may be used. The products may also be sold without separate packaging, because the products themselves may include an aperture for mounting the product on the display device. As such, a stocking device 20 would be configured to engage the aperture, or comparable feature, on the products themselves.

Referring now to the drawings, and with specific reference initially to FIG. 1, the product stocking device is generally indicated by reference numeral 20. The product stocking device 20 includes a storage portion 22 coupled to a loading portion 24. The stocking device 20 is configured to provide an inexpensive and efficient device for handling (e.g., packaging, aligning, organizing, storing, shipping, and stocking) a plurality of packages. Display packages 10 are configured to be added onto the product stocking device 20 at the loading portion 24 and secured on the storage portion 22. The product stocking device 20 is configured to retain or "capture" the product packaging by a non-stretching type of engagement. After display packages 10 have been loaded onto storage portion 22, loading portion 24 is orientated (twisted and bent) to "capture" the packaging to prevent the display packages 10 from sliding off the storage portion 22 until the loading portion 24 is again orientated to allow unloading.

Figure 2:
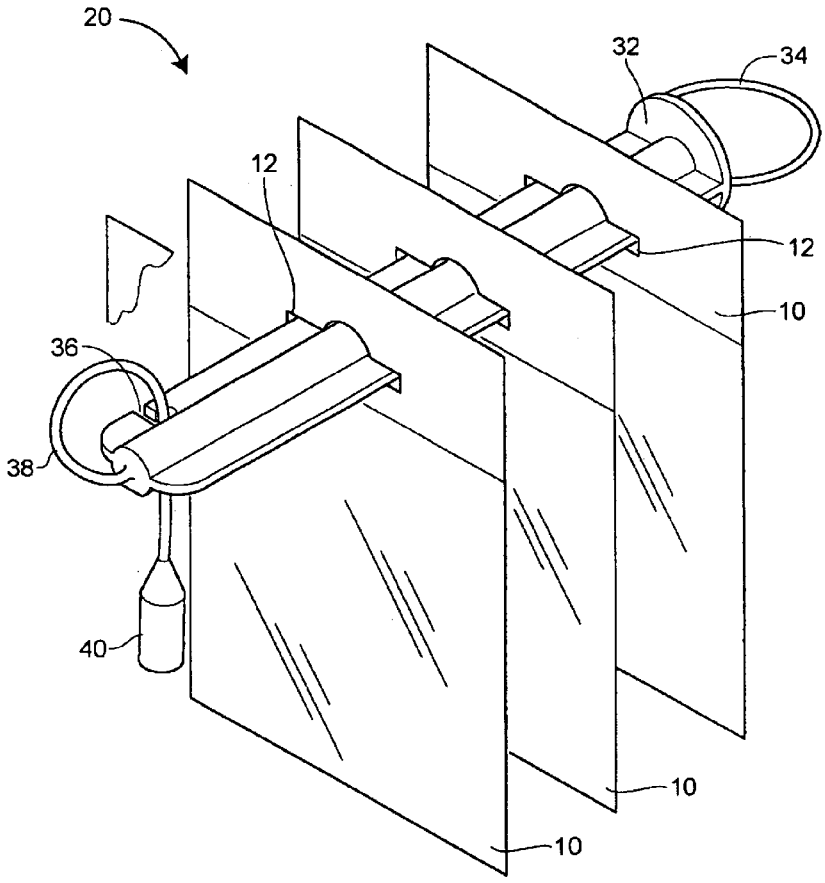
FIG. 2 is a perspective view of a plurality of display packages stored on the product stocking device of FIG. 1.

Storage portion 22 includes a shaft 26 and a pair of opposing fins or flanges 28, 30 extending from shaft 26. The shaft 26 and the flanges 28, 30 are configured to engage with aligned apertures 12 in a plurality of display packages 10. According to alternative embodiments, storage portion 22 may have any of a variety of shapes and configurations designed to engage one or more types of packaging apertures. In this example, the storage portion 22 is sized and shaped to engage apertures 12 in the display packages 10 (i.e., storage portion 22 has a three-sided or so called euro-style cross section that is slightly smaller than apertures 12 in display packages 10). More specifically, as seen in FIGS. 2 and 3, the aperture 12 may include a generally horizontal slot having at least an enlarge semi-circular region in the center thereof. The flanges 28, 30 cooperate with edges of aperture 12 to help keep the display packages 10 properly aligned and oriented.

The storage portion 22, further includes an abutment or stop member 32, located at one end of storage portion 22 (opposite the loading portion), and is configured to prevent display packages 10 from sliding off storage portion 22. The size and/or shape of stop member 32 is dimensioned (e.g., a diameter) so that it is larger than a corresponding dimension of aperture 12 of display package 10. In another example, the stop member 32 includes an area of sufficient size for labeling or other indicia (e.g., product identification, shipping origin, shipping destination, seller information, UPC Code data, buyer/customer information, etc.) A ring or grasping member 34, may be located at an end of storage portion 22 and may be configured to provide a stocker with a member to easily manipulate the product stocking device 20 and/or retain display packages 10, or to provide a coupling member for a packaging machine or fixture.

Located on the storage portion 22 may be a coupling portion or notch 36. The notch 36 is adapted to receive the loading portion 24, and the notch 36 may be a variety of shapes and sizes. In one example, the notch 36 may have a general "L" shape, including a retaining portion 48. The retaining portion 48 may be directed towards the stop member 32 so that the loading shaft 38 is biased into the retaining portion 48 when engaged with the notch 36. Alternatively, retaining portion 48 may be directed away from stop member 32. More specifically, notch 36 may have a width that narrows so that shaft 38 is frictionally gripped by flange 30, such that when shaft 38 is engaged with notch 36, the display packages 10 are retained between stop member 32 and the shaft 38. In other examples, the coupling portion 36 may a clip or other retaining device adapted to hold and/or retain the loading portion 24. The coupling portion 36 also need not be located on the storage portion 22, but may be located next to or near the storage portion 22. For example, the coupling portion 36 may be a knob or a single slit located on the storage portion 22 or the loading portion 24, respectively. Similarly, there may be more than one coupling portion 36 located on the product storage device 20. Further, the coupling portion could be located on the stop member 32, to receive an elongate loading shaft 38.

The loading portion 24 may include a flexible shaft 38 and a tip or head 40. The flexible shaft 38 may be fixedly attached to the storage portion 22, or may be detachable. The shaft 38 of the loading portion 24 is adapted to engage with the notch 36 to prevent display packages 10 from being pulled off the storing portion 22 (e.g., the contortion of shaft 38 and location of head 40). The head 40 and/or storage portion 22 may have any of a variety of shapes and sizes which generally correspond with the shape and size of the aperture 12 (e.g., triangular, rectangular, circular, ovular, clover-leaf, etc.). In another example, the shaft 38 may be rigid and may be adapted to detach from the storage portion 22. While detached, the shaft 38 will be able to engage with the coupling portion 36 to retain the display packages 10 on the product stocking device 20.

The head 40 includes a socket 42 configured to receive a display device 14, such as a peg hook. According to an alternative embodiment, socket 42 may have a variety of shapes and sizes, which are configured to receive peg hook 14. In one example, the head 40 may include an outer dimension 44 (e.g., outer diameter D1) that is less than a correspondingly-shaped dimension of aperture 12. Similarly, the inner dimension 46 (e.g., inner diameter D2) of the head 40, or the diameter of the socket 42, may be larger than the outer diameter or corresponding dimension of the peg hook 14.

The shaft 38 of the loading portion 24 may be configured (e.g., sized and shaped) to be flexible and allow movement of the head 40 relative to the storage portion 22. More particularly, the shaft 38 may be flexibly configured to engage notch 36 in the flange 30 so that display packages 10 once loaded are secured on the storage portion (i.e. between the stop member 32 and the notch 36).

The product stocking device 20 may be formed as a single piece during a single injection molding operation, or the components of the product stocking device 20 may be separately molded and later assembled together (e.g., with adhesive, thermal bonding, fasteners, snap fit engagements, or the like). More specifically, the product stocking device 20 may be constructed from an injection molding process using polypropylene, but even other materials can be used, including other thermoplastic resins such as high density polyethylene, other polyethylenes, acrylonitrile butadiene styrene ("ABS"), polyurethane, Nylon, any of a variety of homopolymer plastics, copolymer plastics, plastics with special additives, filled plastics, etc. Also, other molding operations may be used to form these components, such as blow molding, rotational molding, etc.

Similarly, while the components of the disclosed product stocking device 20 have been and will be illustrated as being used with a three-sided aperture ("euro-style" mounting hole) designed for cardboard panels ("display cards"), the features of product stocking device 20 have a much wider applicability. For example, the product stocking device's design may be adaptable for other packaging containers for any of a variety of office, home, educational, repair and other products that are configured to be mounted to a display. Further, the size of the various components and the size of the apertures, packaging materials, etc. may be widely varied. For example, the display devices may include display hangers, hooks, other elongate rods, or elements that extend from a generally vertical surface of a display.

In operation, the product stocking device 20 is used to hold one or more display packages 10 so that the display packages 10 are uniformly aligned and organized for storage, shipment, stocking, etc. The display packages 10 are created at a packaging or manufacturing facility where the product/products are sealed in display packages 10. The display packages 10 are then loaded onto a stocking device 20 by sliding one or more display packages 10 over head 40 and loading shaft 38, of the loading portion 24, and then onto the storage portion 22. (Product stocking device 20 can be sized to accommodate any number of packages, as desired.) After display packages 10 are loaded onto storage portion 22, shaft 38 is twisted or oriented so that shaft 38 engages notch 36 and is then locked into place in the retaining portion 48.

After a desired quantity of display packages 10 have been loaded onto stocking device 20 and the display packages 10 are retained, the product storage device 20 and the display packages 10 may be removed from a packaging machine and placed in a box or container for storage or shipment. Product stocking device 20 may also be held by a worker and the products or the display packages 10 may be manually placed onto product stocking device 20 or may be mounted to a fixture and/or mounted to an automated product loading apparatus.

In one example, a retainer band 50, such as a rubber band, an elastic band, a flexible band, a non-flexible band or other retaining device, may be wrapped around the plurality of display packages 10 to hold the display packages 10 substantially in line with one another and to prevent the shifting or tangling of products during shipping. After a plurality of display packages 10 have been retained by product stocking device 20, for instance, the plurality of display packages 10 may be bound by the elastic or rubber band 50 around the mid-section of display packages 10 to keep them more firmly and compactly together during delivery of the products. Also, band 50 may prevent each group of display packages 10 from substantially interfering with other groups of display packages 10 in a case, a carton, or a box 52 to be sent to a customer. After display packages 10 have been bound by rubber bands 50, they may be inserted into a case or box 52 to be stored or sent to the customer. A plurality of these bound sets of display packages 10, each being retained by product stocking device 20, may be inserted into a single case.

In another example, however, the display packages 10 need not be bound together by retainer bands 50, because the product stocking device 20 may hold the display packages 10 substantially in line with one another and prevent the shifting or tangling of products by engaging the apertures 12 of the display packages 10 with the storage portion 22. The aperture 12, for example, may be of any shape, including the "euro-style" hole having a round hole with elongate sides, as can be seen in FIGS. 2 and 3, and the storing portion 22, as can be seen in FIGS. 1 and 2, may have a shape complimentary to the aperture 12. More specifically, the shaft 26 may compliment the round part of the aperture 12, and the flanges 28, 30 may each compliment one of the elongate sides of the aperture 12. With both the storing portion 22 and the aperture 12 having complimentary profiles, the display packages 10 may be kept in line with one another and may prevented from shifting or from becoming entangled with one another.

Figure 4:
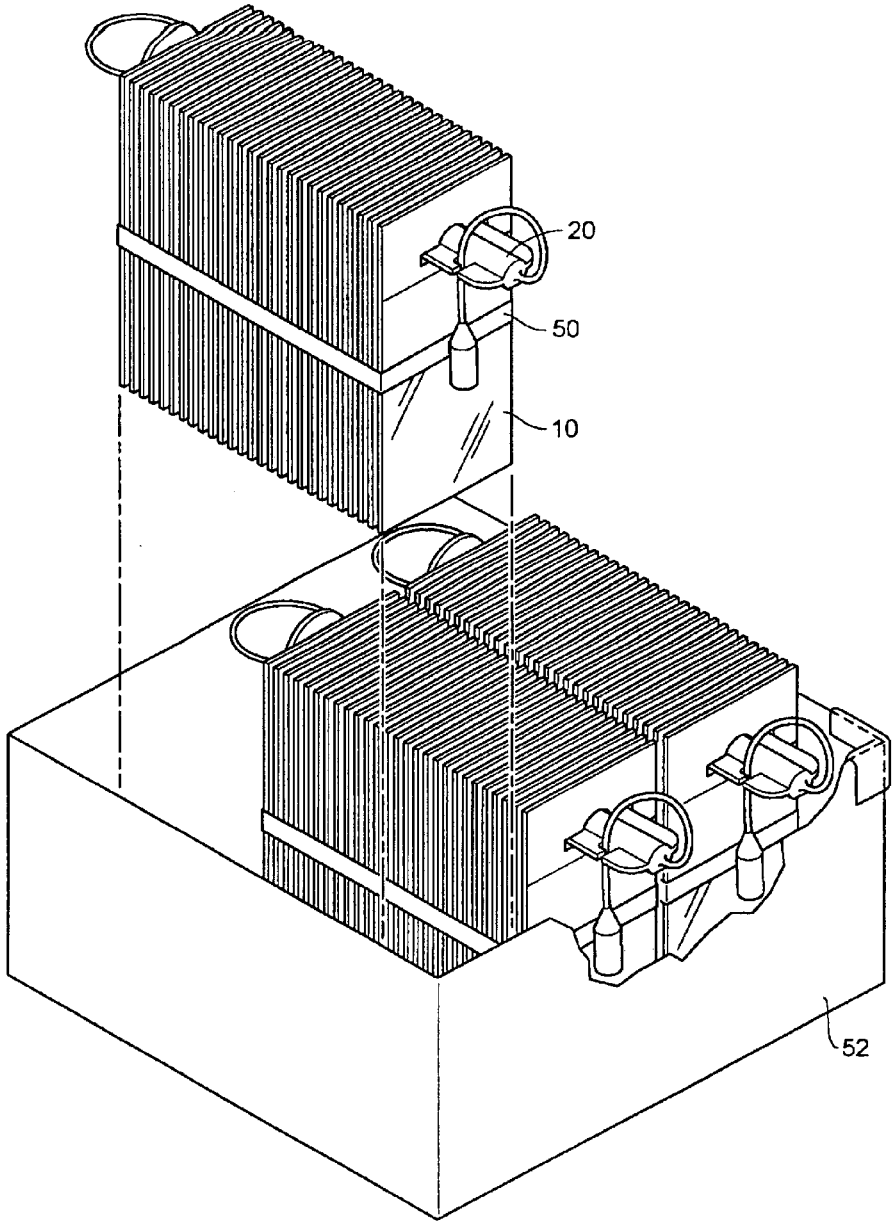
FIG. 4 is a perspective view of a bundle of display packages on a product stocking device being placed into a shipping carton holding a plurality of bundles of display packages.

When box 52 is received at a store (FIG. 4), or any other place where the products are going to be displayed, each retained set of display packages 10 may be lifted from the box or case 52 by grasping the product stocking device 20 and lifting the set of display packages 10 from the box 52. Product stocking device 20 is unloaded by disengaging shaft 38 from notch 36. The head 40, of the loading portion 24, may then be engaged with the display device 14 by engaging socket 40 with the end of the peg hook 14. As can be seen in FIG. 3, because the product stocking device 20 was inserted through apertures 12, apertures 12 (and the display packages 10) will be aligned substantially coaxially. Thus, they may be transferred directly onto peg hook 14 by pushing display packages 10 from their initial position on the storage portion 22, over loading portion 24, and onto peg hook 14. Thus, the user has avoided having to individually mount each separate one of the plurality of display packages 10 onto the peg hook 14. Once the plurality of display packages 10 have been transferred as a group to peg hook 14, stocking device 20 is removed and then disposed of, reused, or recycled.

It is important to note that the construction and arrangement of the elements of the product stocking device 20 and the method as shown herein are only illustrative. Although only a few examples of the product stocking device 20 have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the present invention. For example, elements shown as integrally formed may be constructed of multiple parts or elements. Similarly, the operation of the interfaces may be reversed or otherwise varied, the length or width of the structures and/or members or connector or other elements of the system may be varied, and/or the nature or number of adjustment positions provided between the elements may be varied (e.g. by variations in the number of engagement slots or size of the engagement slots or type of engagement). Also, the product stocking device 20 may have any number of a variety of designs and configurations to work with a variety of display arrangements. Further, the product stocking device 20 could also be made without flexible shaft 38 (e.g., the loading portion only including the head, the loading portion being detachable in order to engage the storage portion, etc.) It should be noted that the elements and/or assemblies of the system may be constructed from any of a wide variety of materials that provide sufficient strength or durability, in any of a wide variety of colors, textures and combinations. It should also be noted that the display system may be used in association with a rotating display, or alternatively other, fixed and non-movable displays or any of a wide variety of other surfaces in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present invention.

What is claimed is:

1. A product stocking device for retaining a plurality of display packages having a mounting, hole, comprising:

a first section having a proximal and distal end, the first section including a stop member disposed near the distal end and an elongate shaft portion, wherein a cross-section of the first section corresponds to the mounting hole having a generally horizontal slot including at least an enlarged, semi-circular region in the center thereof;

a second section having a proximal end and a distal end, wherein the proximal end of the second section is coupled to the proximal end of the first section; and a coupling portion disposed on one of the first and second sections adapted to receive the second section, wherein the second section engages with the coupling portion to retain the plurality of display packages between the proximal and distal ends of the first section.

2. The product stocking device of claim 1, further including a band selectively retaining the plurality of display packages.

3. The product stocking device of claim 1, wherein the first section includes a grasping member.

4. The product stocking device of claim 3, wherein the grasping member is the stop member.

5. The product stocking device of claim 1, wherein the second section further includes a head.

6. The product stocking device of claim 1, wherein the coupling portion is disposed on the first section.

7. The product stocking device of claim 1, wherein the coupling portion is disposed on the stop member.

8. A method of packaging a multiplicity of display packages, each display package having a display aperture, the method comprising:

threading a stocking device, having a first section, a second section, a stop member, and a coupling portion, through the display aperture of a plurality of display packages; and coupling the second section of the stocking device to the coupling portion, thereby retaining the plurality of display packages on the first section.

9. A product stocking device for retaining a plurality of display packages comprising:

a first section having a proximal and distal end, the first section including a stop member, wherein a profile of the first section includes a shaft and a set of flanges and corresponds to the shape of a euro-style mounting hole;

a second section having a proximal and a distal end, wherein the second section is coupled to the first section;

a coupling portion adapted to receive the second section; and the second section engages with the coupling portion to retain the plurality of display packages on the first section between the stop member and the second section.

10. A product stocking device retaining at least one display package comprising:

a first section having a proximal end, a distal end, and a stop member disposed near the distal end, and an elongate shaft portion extending from the proximal to the distal end;

a second section having a proximal end and a distal end, wherein the proximal end of the second section is coupled to the proximal end of the first section; and a coupling portion disposed near the distal end of the first section adapted to receive at least a portion of the second section, wherein the second section engages with the coupling portion thereby retaining the at least one display package between the proximal and distal ends of the first section.

11. The product stocking device of claim 10, wherein the coupling portion is disposed on the first section.

12. A system for packaging a multiplicity of display packages in a shipping container, each display package having a display aperture, the system comprising:

at least one stocking device having a first section and a second section, the first section having an elongate shaft portion, and the second section being threadable through the display aperture in the plurality of display packages;

the at least one stocking device having a coupling portion disposed on one of the first and second sections;

the second section of the at least one stocking device being adapted to engage with the coupling portion, thereby retaining the plurality of display packages on the elongate shaft of the first section.

13. The packaging system of claim 12, wherein the display packages each include an aperture having a profile, and wherein a cross-section of the first section corresponds to the shape of the profile of the apertures.

14. A method of packaging a multiplicity of display packages, each display package having a display aperture, the method comprising:

threading a stocking device, having a first section, a second section, a stop member, and a coupling portion, through the display aperture of a plurality of display packages;

coupling the second section of the stocking device to the coupling portion, thereby retaining the plurality of display packages on the first section; and placing the plurality of display packages being retained by the stocking device into a container.

15. The method of claim 14, further including aligning a profile of the display aperture with a profile of the first section.

16. A method of shipping a multiplicity of display packages, each display package having a display aperture for hanging on a display rack, the method comprising:

threading a stocking device, the stocking device having a first section, a second section, a coupling portion, a stop member, and a head, through the display apertures of a plurality of display packages;

coupling the second section of the stocking device to the coupling portion, thereby retaining the plurality of display packages between the stop member and the second section;

placing the plurality of display packages being retained by the stocking device in a container; and shipping the container.

17. The method of claim 16, further comprising aligning a profile of the display aperture with a profile of the first section.

18. A method of merchandizing a multiplicity of display packages, each display package having a display aperture for hanging on a display rack, the method comprising:

providing a stocking device, having a first section, a second section, a coupling portion, a stop member, and a head, wherein a plurality of display packages are retained on the first section;

removing the plurality of display packages from a container;

removing the second section of the stocking device from the coupling portion;

placing the head onto the display rack; and sliding the display packages from the stocking device onto the display rack.

19. A product stocking device retaining at least one display package comprising:

a first section having a proximal and distal end, the first section including a stop member disposed near the distal end and an elongate shaft portion;

a second section having a proximal end and a distal end, wherein the proximal end of the second section is coupled to the proximal end of the first section; and a coupling portion disposed on one of the first and second sections adapted to receive the second section, wherein the second section engages with the coupling portion thereby retaining at least one display package between the proximal and distal ends of the first section.

20. The product stocking device of claim 19, wherein the coupling portion is disposed on the first section.

21. The product stocking device of claim 19, wherein the coupling portion is disposed on the stop member.

22. The product stocking device of claim 19, further including a band selectively retaining the at least one display package.

23. The product stocking device of claim 19, wherein the first section includes a grasping member.

24. The product stocking device of claim 23, wherein the grasping member is the stop member.

25. The product stocking device of claim 19, wherein the second section further includes a head.

26. A product stocking device for retaining a plurality of display packages comprising:

a first section having a proximal and distal end, the first section including a stop member disposed near the distal end and an elongate shaft portion;

a second section having a proximal end and a distal end, wherein the proximal end of the second section is coupled to the proximal end of the first section and the distal end of the second section includes a head portion having an aperture for receiving a peg hook; and a coupling portion disposed on one of the first and second sections adapted to receive the second section, wherein the second section engages with the coupling portion to retain the plurality of display packages between the proximal and distal ends of the first section.

27. The product stocking device of claim 26, wherein the coupling portion is disposed on the first section.

28. The product stocking device of claim 26, wherein the coupling portion is disposed on the stop member.

29. The product stocking device of claim 26, further including a band selectively retaining the plurality of display package.

30. The product stocking device of claim 26, herein the first section includes a grasping member.

31. The product stocking device of claim 30, wherein the grasping member is the stop member.

* * * * *

UNITED STATES PATENT AND TRADEMARK OFFICE

CERTIFICATE OF CORRECTION

PATENT NO. : 6,704,971 B2
DATED : March 16, 2004
INVENTOR(S) : Larry R. Dossett et al.

It is certified that error appears in the above-identified patent and that said Letters Patent is hereby corrected as shown below:

Column 7,
Line 2, please delete “mounting, hole,” and insert -- mounting hole, --.

Column 8,
Line 8, please delete “in” and insert -- into --.

Column 10,
Line 1, please delete “herein” and insert -- wherein --.

Signed and Sealed this

Thirty-first Day of August, 2004

JON W. DUDAS
*Director of the United States Patent and Trademark Office*